United States Patent [19]

Capers

[11] 4,338,715

[45] Jul. 13, 1982

[54] METHOD FOR INSERTING A VOID PLUG INTO A LIFT INSERT FOR A CONCRETE PRODUCT

[75] Inventor: Billy G. Capers, Canton, Tex.

[73] Assignee: Koppers Company, Inc., Pittsburgh, Pa.

[21] Appl. No.: 158,989

[22] Filed: Jun. 12, 1980

[51] Int. Cl.[3] ..... B23P 11/02

[52] U.S. Cl. ..... 29/451; 29/453; 29/235

[58] Field of Search ..... 29/451, 453, 235; 52/705

[56] References Cited

U.S. PATENT DOCUMENTS

| | | | |
|---|---|---|---|
| 651,267 | 6/1900 | Pickett | 29/235 UX |
| 1,497,185 | 6/1924 | Mitchell | 29/235 UX |
| 1,837,899 | 12/1931 | Daugy | 29/235 X |
| 2,426,749 | 9/1947 | Sebastian | 29/235 UX |
| 2,961,755 | 11/1960 | Prince | 29/235 |
| 2,991,819 | 7/1961 | Lee | 29/451 UX |
| 3,200,422 | 10/1965 | Dritz | 29/451 X |
| 3,400,445 | 9/1968 | Crandall et al. | 29/451 |
| 3,872,806 | 3/1975 | Bone | 29/235 X |
| 4,074,499 | 2/1978 | Mess | 52/705 |
| 4,084,780 | 4/1978 | Mess | 52/705 X |

*Primary Examiner*—Charlie T. Moon

*Attorney, Agent, or Firm*—Thomas F. Shanahan; Oscar B. Brumback; Herbert J. Zeh, Jr.

[57] ABSTRACT

Articles and a method are disclosed useful for providing a lift insert for a cast concrete product, such as a cast concrete slab or panel. The articles include a threadless plug for temporary insertion into an insert for receiving a lifting device in a cast concrete product, an insertion tool therefor, and the insert assembly. The threadless plug is characterized by an elastomeric tubular member having closure and/or abutment means on each end and dimensioned such that, in its operative position in the lift insert, such as a coil insert, the portion of the tubular member between the ends is placed in tension to positively seal against ingress of concrete into the top of the coil or insert and between the void plug and the coil during casting. The tool and method involve laterally inserting a flattened and then folded lower portion of the threadless tubular plug into a tubular tool member, longitudinally inserting the plug and tool member into the top of a cylindrical lift insert, longitudinally stretching the plug by frictional engagement with the tubular tool member and contemporaneous engagement of the upper abutment means with the lift insert, while withdrawing the tool member from the insert, and compressively affixing the lower abutment means in overlying intimate contact with the lower end of the insert upon total withdrawal so as to place the intermediate portion of the plug between the abutment means in tension.

9 Claims, 5 Drawing Figures

METHOD FOR INSERTING A VOID PLUG INTO A LIFT INSERT FOR A CONCRETE PRODUCT

BACKGROUND OF THE INVENTION

1. Field of the Invention

This invention relates to the lifting of cast concrete products and, more specifically, to novel means and a method for providing a lift insert, such as a coil insert, for imbedment in a cast concrete slab or panel for receiving a lifting device to hoist the slab or panel into a desired position.

2. Description of the Prior Art

As described in U.S. Pat. No. 4,074,499, in recent years a form of building construction referred to as the tilt-up slab method has come into rather wide usage. In tilt-up slab building, large concrete slabs are formed either on the floor of the building or on a level ground surface. The concrete slabs are then lifted to a vertical position and interconnected to form the walls of the building.

The attachment to the slabs which are used for lifting them must be removable after the slabs have been lifted into place to facilitate the provision of a smooth surface on the walls of the building. Generally, the lifting attachments, such as a lifting ring and bolt, are installed and removed at the building site, and therefore they are designed to be easily and rapidly installed and removed in order to save maximum time.

The insert into which the bolt is threaded is normally permanently embedded in the slab or panel. When the lifting attachments are removed from the slab, a hole where the insert is located remains in the slab and must be filled to provide a smooth outer surface. The insert should therefore be small enough to be easily and readily concealed after the slab has been installed, and yet should be able to sustain the forces of lifting heavy slabs or panels. Also, it should not interfere with rapid attaching and detaching of the lifting means.

The art has for many years used bolts of conventional types having relatively coarse threads, including nut headed bolts for use with lifting devices into which a hoist can be attached, and also eye bolts which do not require separate lifting rings. A more recent development in the art is a split bolt, such as disclosed in Grayson's U.S. Pat. No. 3,922,946, which can be rapidly inserted without being threaded into an insert in a slab and can then be tightened in place by only a partial revolution.

Such a split bolt comprises a pair of separate longitudinal segments such as would be formed if a conventional bolt is split along its axis and then a portion removed along the axis from each segment so that when the two segments are placed together, they can be inserted axially into an insert sized for threaded reception of the entire bolt. An axially movable key member or wedge is used to replace the removed portions and thereby to spread the two segments into threaded engagement with the insert, and a partial turn of the bolt will tighten it securely in place. The bolt is removed by withdrawing the key, thereby enabling the two segments to be brought together out of threaded engagement with the insert for axial withdrawal without rotation.

The inserts commonly used with both solid bolts and split bolts comprise a coil of a plurality of turns of heavy wire or rod stock. This coil is welded to supporting leg members or the like for locating the coil in proper position in a poured concrete slab or panel, commonly by setting the foot portions of the leg members on the form on which the slab is poured. Experience has established that there is a practical minimum number of turns in a coil and threads on a coil bolt which must be in engagement to assure adequate lifting strength without causing the coil turns to separate and to release the bolt.

A number of alternative means have been used in the art for space-establishing purposes, including plugs of various kinds which serve to prevent access of fluid concrete both to the interior of the coil and into a space immediately adjacent the inner end of the coil, and which can be burnt out or otherwise removed after the concrete is set. Among patents showing a plug of special characteristics for this purpose are U.S. Pat. Nos. 4,074,499 to Mess, 2,880,608 to Boll et al., 3,216,171 to Jenkins, 3,590,538 to Holt and 3,742,661 to Tye. The plugs of all such patents, however, offer certain disadvantages from the standpoint of both cost and simplicity of use, as now briefly summarized.

While U.S. Pat. No. 4,074,499 comprised an improvement over the prior art, in practice, certain difficulties are encountered in inserting the plug and, whether threaded full length or only at the ends, there is never any certainty that the plug is properly seated or threadably matched with the coil insert. The use of an oversized, elastomeric threaded plug, theoretically, should provide a superior seal and the ability to stretch the plug with a rod for insertion from the bottom would appear to facilitate ease of installation. The complete removability of the plug is also advantageous. However, as aforesaid, in practice there is never any certainty that the plug is properly seated or threadably matched with the coil insert. Moreover, intimate alignment of the provided locator lug with the upper end of the coil is both difficult to accomplish on initial insertion and virtually impossible to adjust once insertion is completed.

Boll et al. discloses the use of a filler plug described as composed of sponge rubber or some easily compressed rubber or elastic material allowing the plug to be easily inserted and to retain itself in place, yet to be easily subsequently removable. Boll et al, however, do not teach how to insert or remove the plug and, apparently, it would have to be crammed into place and subsequently dug out piecemeal. Each of the other three patents show a two-part plug which must be separately threaded or otherwise fitted in place at opposite ends of the coil prior to installation, with the outer plug being removed after the concrete has set and with the inner plug remaining in place for partial destruction by the coil bolt as it is threaded into the insert.

SUMMARY OF THE INVENTION

In accordance with the present invention, there is disclosed an improved void plug and method of installation that is useful for providing a lift insert for a cast concrete product, such as a cast concrete slab or panel. More specifically, disclosed are a threadless plug for temporary insertion into an insert for receiving a lifting device in a cast concrete product, an insertion tool therefor and the insert assembly. The threadless plug is characterized by an elastomeric tubular member having closure and/or abutment means on each end and dimensioned such that, in its operative position in the lift insert, such as a coil insert, the portion of the tubular member between the ends is placed in tension to positively seal against ingress of concrete into the top of the coil or insert and between the void plug and the coil during casting. The installation tool and method involve laterally inserting a flattened and then folded lower portion of the threadless tubular plug into a tubular tool member, longitudinally inserting the plug and tool member into the top of a cylindrical lift insert, longitudinally stretching the plug by frictional engagement with the tubular tool member and contemporaneous engagement of the upper abutment means with the lift insert, while withdrawing the tool member from the insert, and compressively affixing the lower abutment means in overlying intimate contact with the lower end of the insert upon total withdrawal so as to place the intermediate portion of the plug between the abutment means in tension.

The foregoing and other objects, features and advantages of this invention will become more apparent with further consideration of the disclosure thereof and, in particular, when viewed in conjunction with the following portion of the specification, the accompanying drawings and the appended claims.

DESCRIPTION OF THE PREFERRED EMBODIMENT

Figure 1:
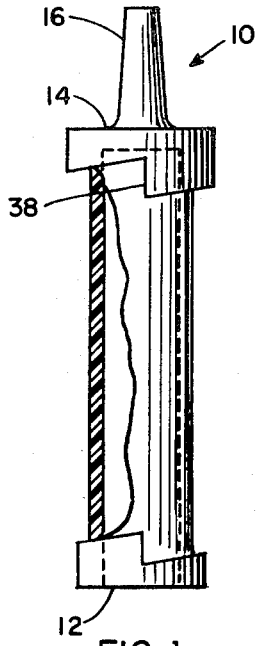
FIG. 1 is an elevation, partly in section, of the novel void plug of this invention.
Figure 2:
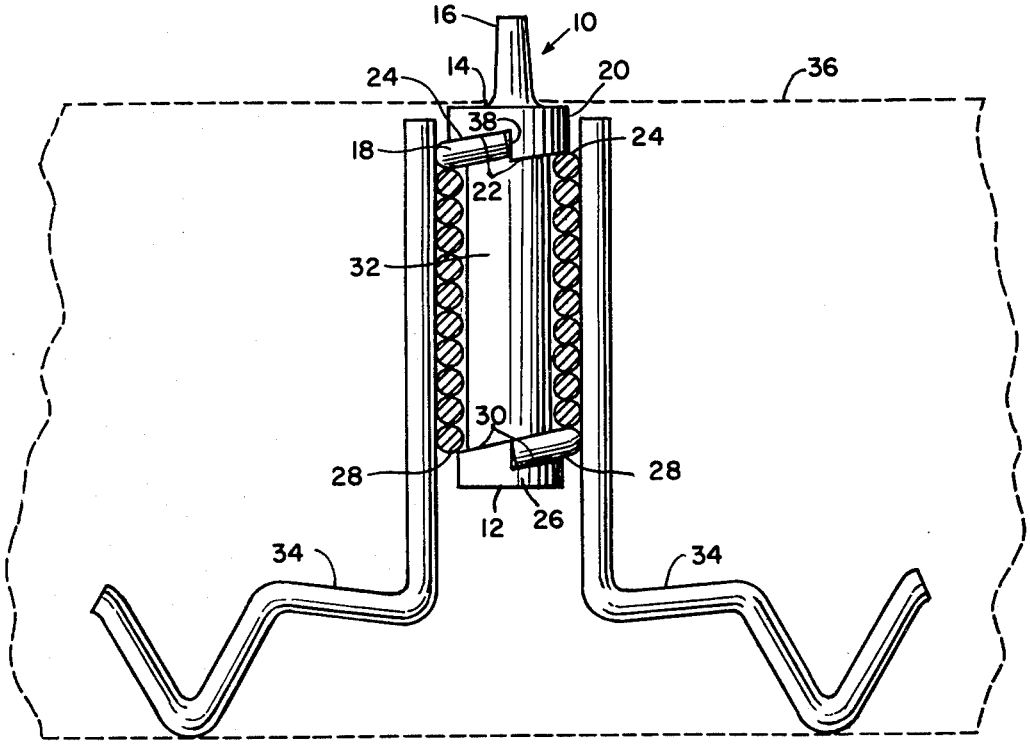
FIG. 2 is an elevation, partly in section, showing the void plug of the invention installed in a coil insert in a cast concrete product.

Referring to the drawings and, in particular, FIGS. 1 and 2 thereof, there is shown a void plug 10 of this invention. With particular reference to FIG. 1, lift insert plug or void plug 10 is an elongated, hollow, cylindrical, elastomeric member molded from polyvinyl chloride or like material and preferably having a Shore A durometer of about 60 to 75. As shown, plug 10 is open at its bottom end 12 and closed at its top end 14. Integral with the closed top end 14 there is formed an upstanding stem or tab 16 for plug locating and extracting purposes as is fully disclosed in U.S. Pat. No. 4,074,499, incorporated herein by reference. As disclosed in said patent, tab or stem 16 is nominally about one inch in length and is preferably of a diameter less than that of the plug body so that it will flex during standard screeding operations, but of sufficient strength to withstand a pulling force applied thereto for withdrawal of the plug from its companion insert after the cast concrete has set. As shown in FIG. 2, tab 16 extends for substantially its full height above the upper surface of the cast concrete product.

As illustrated in the drawings and, in particular, in FIG. 2, for use with a wound-wire coil insert 18, plug 10 is preferably provided at its upper or closed end 14 with an integral annular collar or abutment means 20 extending radially from the closed end 14 of the void plug 10 and having a shoulder 22 shaped conformably to the shape of the upper end 24 of insert 18. Similarly, plug 10, as shown, is preferably provided at its lower or open end 12 with an integral collar or abutment means 26 extending radially from open end 12 to reside against the lower end 28 of the insert 18 and, most preferably, comprising a collar having a shoulder 30 shaped conformably to the shape of the lower end 28 of the insert 18. Although other geometric configurations are possible, depending upon the geometric shape of the upper end and the lower end of the particular insert employed, in the embodiment shown, the shoulders 22 and 30 intimately coincide with and follow the generally helical contour of the exposed end surfaces of upper end 24 and lower end 28 of the wound-wire coil insert 18. Accordingly, the shoulders 22 and 30, shown, essentially comprise helical ramps for intimate abutment and sealing engagement with the exposed end surfaces of the wound-wire coil insert 18. For ease of mold construction, the shoulders 22 and 30 are shown as extending generally perpendicularly from the intermediate portion 32 of the void plug 10, between the end collars 20 and 26.

With further reference to FIG. 2, certain distinguishing features should be pointed out in connection with plug 10. For example, the elongated intermediate portion 32 of void plug 10, between the end collars 20 and 26, preferably has an outside diameter that is less than the minimum inside diameter or core diameter of the wound-wire coil insert 18. Also, shoulder 22 is preferably of a greater lateral extent than shoulder 30. Typically, shoulder 22 will desirably overlie upper coil end 24 at least to the lateral extent of reaching to the center of the wire or rod forming the wound-wire coil insert 18. On the other hand, the shoulder 30 may be of a lateral extent of perhaps only 60 percent to 75 percent of that of shoulder 22.

Moreover, as compared to the threaded plug arrangement of U.S. Pat. No. 4,074,499, the void plug 10 of this invention is not threaded and, in particular, the outer surface of the intermediate portion 32 of void plug 10 is free of threads. In addition, the longitudinal distance between collars and/or abutment means 20 and 26 or between shoulder 22 and shoulder 30 is less than the corresponding length of the coil insert 18 such that, upon insertion, the threadless plug may be stretched so as to place the end collars 20 and 26, or other suitable abutment means, in overlying intimate contact with the respective upper end 24 and lower end 28 of the insert 18. It will be understood that, as thus inserted or installed, intermediate portion 32 of the elastomeric plug will be in tension and accordingly will provide and maintain firm engagement of the plug within the coil insert. It will also be understood that each of the various distinguishing features mentioned above are designed to contribute to the overall facile insertion, orientation of the upstanding surface 38 with the upper coil end, and securement of the void plug 10 in coil insert 18, while contemporaneously providing for ready removal of the void plug once the cast concrete is set.

As is conventional, wound-wire coil insert 18 is formed of a plurality of closely spaced turns of heavy wire or rod defining an internal screw thread surface which will accept the threads of a coil bolt, such as the split bolt construction disclosed in Grayson's U.S. Pat. No. 3,922,946. Coil insert 18 is further provided with supporting legs 34, generally four in number, which rest on the surface of the bottom of the mold (not shown) and support the coil insert at a proper elevation relative to the upper surface of the concrete product being cast, such as concrete slab 36. The vertical portion of legs 34 are welded to the turns of the coil 18 to secure the adjacent turns together and thereby enable the coil to retain the lifting coil bolt against being stripped out by the lifting forces which act thereon when hoisting the cast concrete product into its final desired position.

Figure 3:
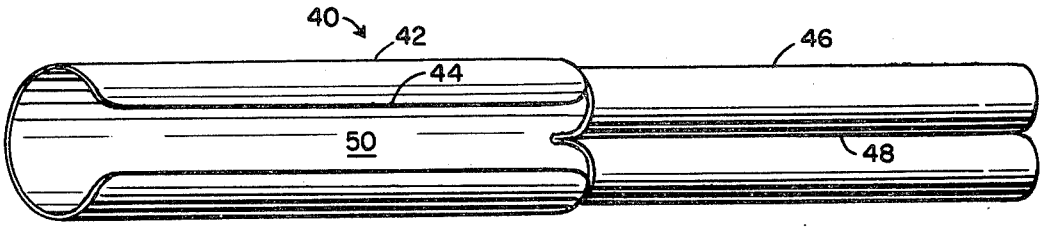
FIG. 3 is a perspective of the void plug installation tool of the invention.
Figure 4:
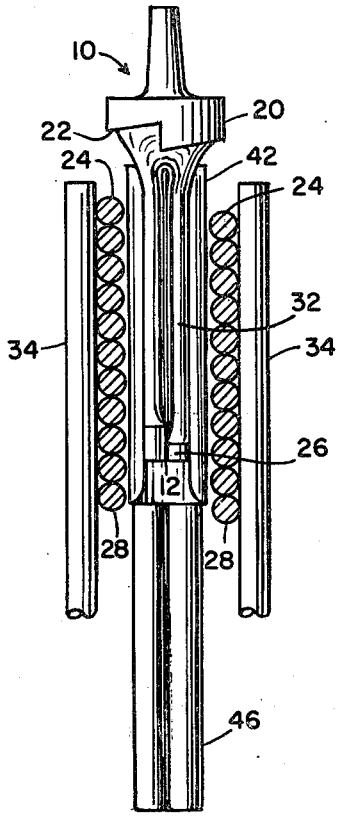
FIG. 4 is an elevation, partly in section and partly broken away, showing an intermediate step in the installation of the novel void plug in a coil insert.
Figure 5:
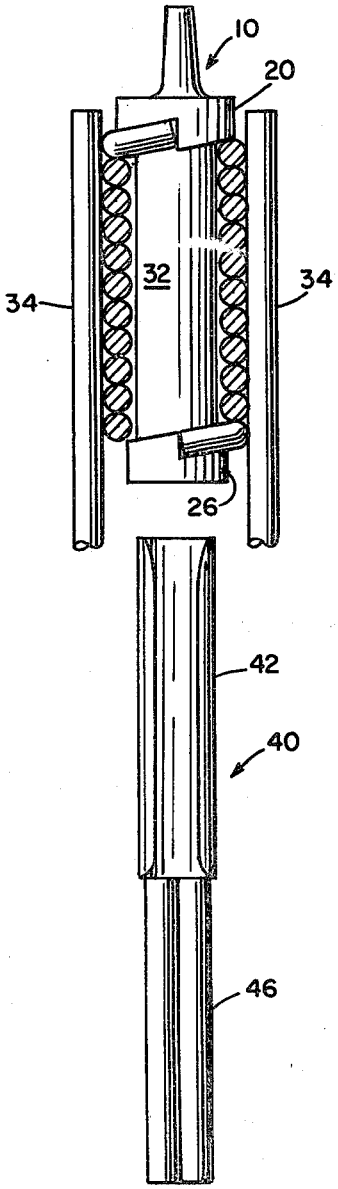
FIG. 5 is an elevation, partly in section and partly broken away, showing completed installation of the void plug in a coil insert.

Turning now to FIG. 3, there is shown a novel void plug insertion tool 40 useful in the practice of this invention. Tool 40 essentially comprises an elongated tubular support member 42, such as a length of metal conduit, preferably having a longitudinal slot 44 extending from one end thereof and of a width sufficient for lateral insertion of the flattened and then folded lower portion or open end 12 of tubular void plug 10 into the support member 42. Desirably, as shown in FIG. 4, a substantial portion of the length of the void plug 10, below upper abutment means or collar 20, is in this manner inserted into support member 42. As thus inserted, lower abutment means or collar 26, being of a larger diameter than that of the intermediate portion 32 of the plug 10, provides the zone or area of primary frictional engagement of the folded plug 10 within the tubular support member 42. As shown, slotted tubular support member 42 has a handle 46 longitudinally attached thereto, the tubular member and the handle being dimensioned to pass longitudinally through an insert, such as coil insert 18, and collectively being of a length greater than the insert. In the particular tool 40 shown, a length of metal conduit was first transversely cut about one-half way through its circumference at a desired location for the juncture of the support member 42 and the handle 46, the handle or handle portion 46 was longitudinally crimped as indicated at 48 for good hand holding characteristics and then metal was removed along the length of support member 42 from its free end to its juncture with handle 46 to provide a slot of desired width to laterally receive a flattened and folded void plug 10. Obviously, however, other forms of construction of tool 40 are well within the skill of the art. For example, a simple cylindrical tube member could be employed into which the folded plug is longitudinally inserted. Moreover, for reasons that will be clearer hereinafter, should additional frictional engagement be desired between void plug 10 and the inner cylindrical surface 50 of tool 40, such surface 50 could readily be provided with serrations (not shown) or the like for this purpose.

In performing the plug insertion method of this aspect of the invention the following procedure is employed with reference to FIGS. 1 and 3 to 6 hereof. First, the elastomeric, threadless, tubular plug member 10 is flattened and then folded at its lower or open end portion 12 and laterally inserted into tubular support member 42 of tool 40 through longitudinal slot 44. As aforesaid, it is desirable that a substantial intermediate portion 32 of the length of the void plug 10, below upper abutment means or collar 20, is in this manner inserted into support member 42. Then the tubular tube member 40 and therein retained void plug 10 are longitudinally inserted into the top or through the upper end 24 of the cylindrical insert 18. By grasping the handle 46, extending through the lower end 28 of insert 18, the plug is adjusted so that shoulder 22 fits conformably to the upper end 24 of insert 18 and upstanding surface 38 abuts or substantially abuts the coil upper end. Thence the plug is longitudinally stretched by frictional engagement of the plug with surface 50 of the tubular tool member 40 and by contemporaneous engagement of the upper abutment means or collar 20 with the upper end 24 of insert 18 during simultaneous longitudinal withdrawal of the tubular tool member from the insert. Finally, the lower abutment means or collar 26 is compressively affixed in overlying intimate contact with the lower end 28 of insert 18 upon total withdrawal of the tool from the plug so as to place the intermediate portion 32 of the plug 10, between the upper abutment means 20 and the lower abutment means 26, in tension.

According to the provisions of the patent statutes, the foregoing explains the principle, preferred construction and mode of operation of the invention and there has been illustrated and described what is now considered to represent its best embodiment. However, it should be understood that, within the scope of the appended claims, the invention may be practiced otherwise than as specifically illustrated and described.

What is claimed:

1. A method for insertion of a threadless, tubular plug into a cylindrical insert for receiving a lifting device, prior to imbedment of said insert in a concrete product, and wherein said plug includes an elastomeric tubular body member closed at an upper end and open at a lower end and having an upper insert end abutment means adjacent said closed end and a lower insert end abutment means adjacent said open end, said method comprising:

(a) laterally inserting the flattened and then folded open end and lower insert abutment means of said plug into a longitudinal slot of a width sufficient therefore in a tubular tool member;

(b) longitudinally inserting said plug and said tubular tool member into the top of said cylindrical insert;

(c) longitudinally stretching said plug by frictional engagement thereof with said tubular tool member and engagement of said upper abutment means with said insert while, contemporaneously, longitudinally withdrawing said tubular tool member from said insert; and (d) compressively affixing said lower abutment means in overlying intimate contact with the lower end of said insert upon total withdrawal therefrom of said tubular tool member so as to place the intermediate portion of said plug between said upper and lower abutment means in tension.

2. A method as in claim 1 in which said upper abutment means extends radially from said closed end and comprises an integral annular collar having a shoulder shaped conformably to and in intimate contact with the shape of said upper end of said insert.

3. A method as in claim 2 in which said lower abutment means extends radially from said open end and comprises an integral annular collar having a shoulder shaped conformably to and in intimate contact with the shape of said lower end of said insert.

4. A method as in claim 3 wherein said insert is a wire coil and each said shoulder comprises a helical ramp extending substantially perpendicular from said body member and having an upstanding surface joining the ends thereof.

5. A method as in claim 4 in which said helical ramp at the closed end of said plug is wider than said helical ramp at the open end of said plug.

6. A method as in claim 4 wherein the outside diameter of said body member between said helical ramps is less than the minimum inside diameter of said insert.

7. A method as in claim 6 which further includes orienting said upstanding surface joining the ends of said upper helical ramp in alignment with the upper end of said wire coil before withdrawing said tool member from said insert.

8. A method as in claim 7 which further includes tab means extending from said closed end of said plug of sufficient strength for applying a force for withdrawal of said plug from said insert.

9. A method as in claim 8 which includes laterally inserting a substantial portion of the longitudinal extent of said tubular body member into said tubular tool member through a longitudinal slot of a length sufficient therefor.

* * * * *